US005577665A

United States Patent [19]

Chang

[11] Patent Number: 5,577,665

[45] Date of Patent: Nov. 26, 1996

[54] SPRAY ARM OF AUTOMATIC TABLEWARE WASHER

[75] Inventor: Jae W. Chang, Kyungki-Do, Rep. of Korea

[73] Assignee: Goldstar Co., Ltd., Seoul, Rep. of Korea

[21] Appl. No.: 650,067

[22] Filed: May 16, 1996

Related U.S. Application Data

[63] Continuation of Ser. No. 346,377, Nov. 29, 1994, abandoned.

[30] Foreign Application Priority Data

Dec. 1, 1993 [KR] Rep. of Korea ..... 26064/1993
Nov. 9, 1994 [KR] Rep. of Korea ..... 29330/1994

[51] Int. Cl.[6] ..... B05B 3/06

[52] U.S. Cl. ..... 239/256; 239/570

[58] Field of Search ..... 239/251, 256, 239/259, 570, 571

[56] References Cited

U.S. PATENT DOCUMENTS

| | | | |
|---|---|---|---|
| 3,160,164 | 12/1964 | Constance | 239/256 X |
| 3,261,554 | 7/1966 | Perl | 239/256 |
| 3,447,752 | 6/1969 | Hardy | 239/251 |
| 3,797,509 | 3/1974 | Fukuzawa et al. . | |
| 3,813,043 | 5/1974 | Mordehai | 239/570 |
| 4,175,575 | 11/1979 | Cushing . | |
| 4,210,285 | 7/1980 | Dicken | 239/251 |
| 4,884,585 | 12/1989 | Oh . | |

FOREIGN PATENT DOCUMENTS

| | | | |
|---|---|---|---|
| 1907295 | 6/1970 | Germany . | |
| 1628755 | 1/1971 | Germany . | |
| 2444664 | 9/1973 | Germany | 239/251 |
| WO93/12706 | 7/1993 | WIPO . | |

*Primary Examiner*—Kevin Weldon
*Attorney, Agent, or Firm*—Fliesler, Dubb, Meyer & Lovejoy

[57] ABSTRACT

A reversible rotation device for a spray arm of an automatic tableware washer is disclosed. The reversible rotation device has a rotatable streamline hollow spray arm and a rotary blade disc control unit. The spray arm has top spray nozzles on its top plate. A pair of first water jet nozzles are formed on an end section of the spray arm, while a pair of second water jet nozzles are formed on the spray arm axially inside the first nozzles and spaced apart from the first nozzles by a distance. A deflector for guiding water jets from the first and second nozzles is provided on the first and second nozzles. The rotary blade disc control unit is placed in the spray arm under the jet nozzles and periodically alternately rotates the spray arm in opposed directions.

6 Claims, 6 Drawing Sheets

SPRAY ARM OF AUTOMATIC TABLEWARE WASHER

This application is a file wrapper continuation of patent application Ser. No. 08/346,377, filed Nov. 29, 1994, now abandoned.

BACKGROUND OF THE INVENTION

1. Field of the Invention

The present invention relates in general to a spray arm rotation device of an automatic tableware washer and, more particularly, to a structural improvement in such a spray arm rotation device for improving tableware washing effect by achieving reversible rotation of spray arm when spraying water upon tableware and washing the tableware.

2. Description of the Prior Art

With reference to FIG. 1, there is shown a spray arm of a tableware washer having a typical rotation device. In the drawing, the reference numeral 1 denotes a rotatable streamline spray arm that is a hollow symmetric body. A water inlet pipe 4 is coupled to the center of the bottom plate of the spray arm 1. The opposed side edges of the spray arm 1 are provided with side jet nozzles 3, which side jet nozzles 3 are diagonally opposed to each other and rotate the spray arm 1 about the pipe 4 by water jetting force as will be described herein later. The spray arm 1 is also provided with a plurality of top spray nozzles 2 on its top plate.

In operation of the above spray arm, the water is supplied to the interior of the hollow spray arm 1 through the water inlet pipe 4. The water in turn is primarily jetted from the side nozzles 3 at a water jetting velocity.

When the water is jetted from the side nozzles 3 as described above, the water jetting forces generated at the nozzles 3 cause the spray arm 1 to be rotated counterclockwise about the water inlet pipe 4 in a direction opposed to the water jetting direction of the jet nozzles 3 as shown at the arrow of FIG. 1 due to the third law of motion. As a result of rotation of the spray arm 1, the top spray nozzles 2 of the spray arm 1 spray the water upon the tableware while varying their spraying angles, thus to wash the tableware.

However, the above rotation device for spray arm 1 has a problem as follows. That is, the side jet nozzles 3 of the rotation device are fixed to the opposed edges of the spray arm 1 and always jet the water in predetermined directions, so that the rotation device can not help rotating the spray arm 1 in a predetermined direction opposed to the water jetting direction of the side jet nozzles 3. In this regard, the water spraying directions of the top spray nozzles 2 of the spray arm 1 are fixed, so that the top spray nozzles 2 fail in uniform and effective washing of the tableware.

If described in detail the operation of the spray arm 1 having the above rotation device, the water spraying direction of the top spray nozzles 2 is perpendicular to the rotating direction of the spray arm 1. Therefore, trace of the sprayed water of the top spray nozzles 2 of the spray arm 1 becomes the tangent line of the rotating direction of the spray arm 1 as shown in FIG. 2A.

As described above, the trace of the sprayed water of the top spray nozzles 2 of the spray arm 1 is set by the rotating direction of the spray arm 1, so that the trace of the sprayed water of the top spray nozzles 2 is inevitably fixed when the rotating direction of the spray arm 1 is fixed.

For example, when letting bowls be placed in the tableware washer as shown in FIGS. 2B and 2C and letting the spray arm 1 be rotated so as to form water spraying direction as shown in FIG. 2B, the sprayed water successfully washes the outside surfaces of the bowls but fails in successful washing of the inside surfaces of bowls. On the contrary, when letting the bowls be placed in the tableware washer as shown in FIGS. 2B and 2C and letting the spray arm 1 be rotated so as to form water spraying direction as shown in FIG. 2C, the sprayed water successfully washes the inside surfaces of the bowls but fails in successful washing of the outside surfaces of bowls.

As described above, the typical rotation device for spray arm of tableware washer has the problem that the rotation device can not help rotating the spray arm in a predetermined fixed direction, so that the spray arm fails in successful washing of the tableware regardless of rotating direction of the spray arm.

SUMMARY OF THE INVENTION

It is, therefore, an object of the present invention to provide a reversible rotation device for a spray arm of an automatic tableware washer which overcomes the above problems by rotating the spray arm in opposed directions, thus to improve the washing effect of the tableware washer.

In order to accomplish the above object, a reversible rotation device for a spray arm of an automatic tableware washer in accordance with a preferred embodiment of the present invention comprises a rotatable streamline hollow spray arm and a rotary blade disc control unit, which spray arm includes a plurality of top spray nozzles provided on a top plate of the spray arm, a pair of first water jet nozzles provided on an end section of the spray arm, a pair of second water jet nozzles provided on the end section of the spray arm axially inside the first water jet nozzles and spaced apart from the first water jet nozzles by a distance, and a deflector for guiding directions of water jets from the first and second water jet nozzles, and which rotary blade disc control unit is placed in the interior of the spray arm under the first and second water jet nozzles and periodically alternately rotates the spray arm in opposed directions.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
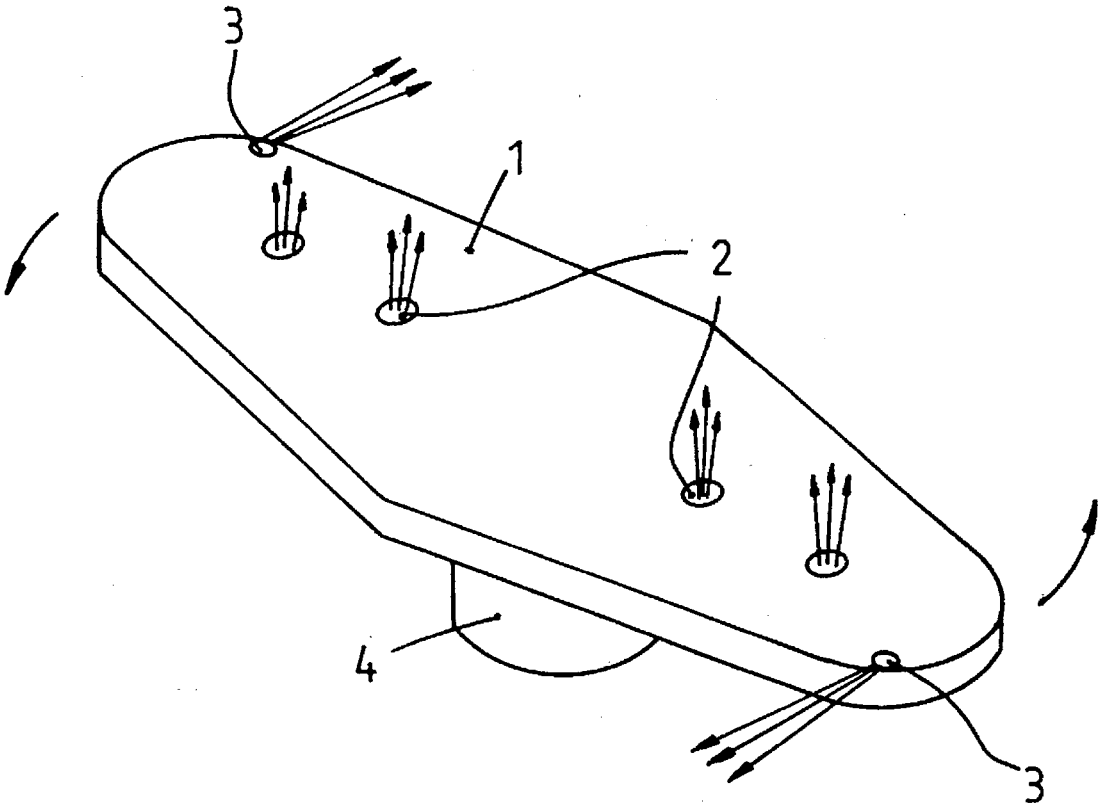
FIG. 1 CONVENTIONAL ART
FIG. 1 is a perspective view a spray arm of a tableware washer having a typical rotation device.
Figure 2A:
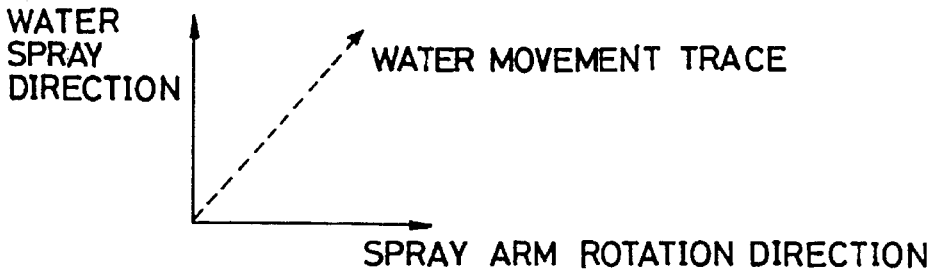
FIG. 2A CONVENTIONAL ART
FIG. 2A is a graph showing a sprayed water trace in accordance with a rotating direction of the spray arm of FIG. 1.
Figure 2B:
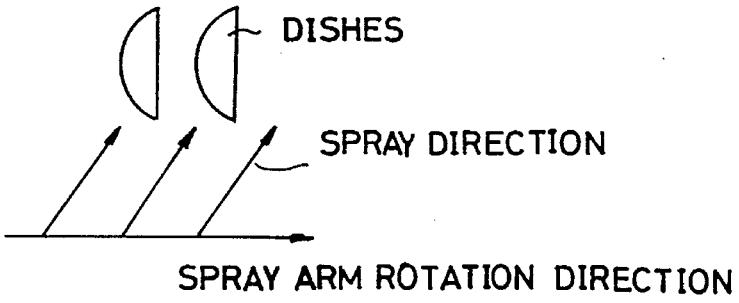
FIG. 2B CONVENTIONAL ART
FIG. 2B is a schematic view showing a bowl washing operation of the spray arm of FIG. 1 when the spray arm is rotated in a fixed direction.
Figure 2C:
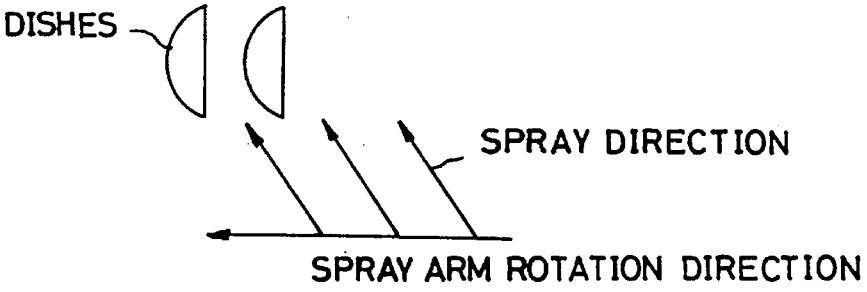
FIG. 2C CONVENTIONAL ART
FIG. 2C is a schematic view showing a bowl washing operation of the spray arm of FIG. 1 when the spray arm is rotated in another fixed direction opposed to the direction of FIG. 2B.
Figure 3A:
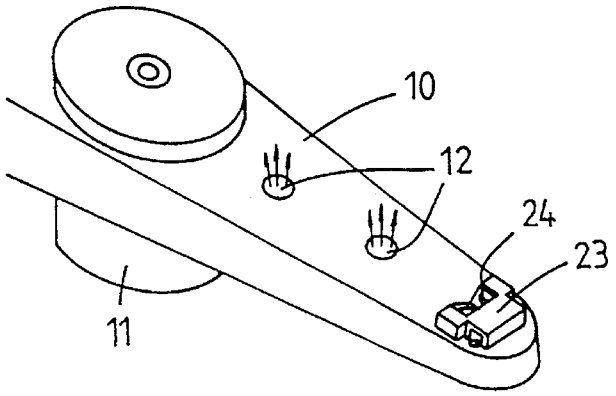
FIG. 3A is a partial perspective view of a spray arm of an automatic tableware washer having a reversible rotation device in accordance with a preferred embodiment of the present invention.

With reference to FIG. 3A, there is shown in a partial perspective view a spray arm of an automatic tableware washer having a reversible rotation device in accordance with a preferred embodiment of the present invention. In the drawing, the reference numeral 10 denotes a rotatable streamline spray arm that is a hollow symmetric body. A water inlet pipe 11 is coupled to the center of the bottom plate of the spray arm 10, while a plurality of top spray nozzles 12 are formed on the top plate of the spray arm 10.

Figure 3B:
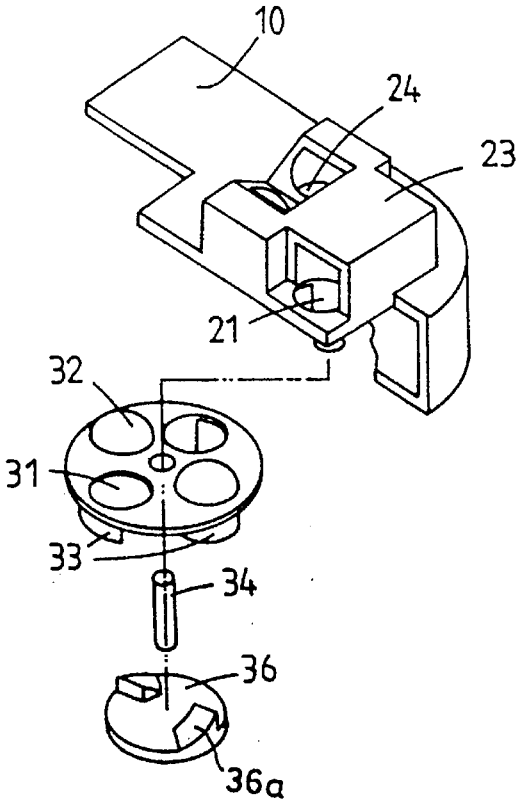
FIG. 3B is an exploded perspective view of a rotary blade disc control unit of the reversible rotation device of FIG. 3A.
Figure 3C:
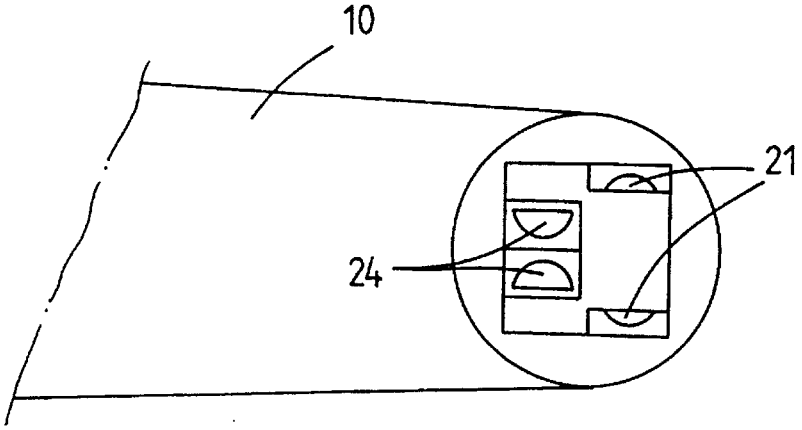
FIG. 3C is a partial plan view of the spray arm of FIG. 3A.

The spray arm reversible rotation device of the invention includes a pair of first water jet nozzles 21, which nozzles 21 are provided on opposed sides of an end section of the spray arm 10 and widthwise spaced out at an interval as shown in FIGS. 3B and 3C. In addition, a pair of second water jet nozzles 24 are provided on the end section of the spray arm 10 axially inside the first nozzles 21. The second nozzles 24 are spaced out at an interval equal to that between the first nozzles 21. Therefore, the first and second nozzles 21 and 24 are positioned beside each other and generally quadrantally spaced out at right angles, so that either first nozzle 21 is diagonally opposed to an associated second nozzle 24. The spray arm reversible rotation device also includes a deflector 23 that is provided on the end section of the spray arm 10, so that the deflector 23 covers all the nozzles 21 and 24. Here, the deflector 23 is partially opened at its opposed sides above the first nozzles 21, so that the first nozzles 21 open to the opposed sides of the spray arm 10 as shown in FIG. 3C. In addition, the deflector 23 has a V-shaped cutout notch above the second nozzles 24, so that the second nozzles 24 obliquely open to the top of the spray arm 10. Placed in the interior of the spray arm 10 under the first and second nozzles 21 and 24 is a rotary blade disc control unit 13.

A construction of the rotary blade disc control unit 13 will be described hereinbelow.

The control unit 13 includes a shaft 34 whose opposed ends are vertically fixedly coupled to interior surfaces of the top and bottom plates of the spray arm 10 respectively at the center of the jet nozzles 21 and 24. Placed in the interior of the spray arm 10 under the first nozzles 21 is a rotary blade disc 30 having a shaft hole **30*a* at its center, which rotary blade disc 30 is movably fitted over the vertical shaft 34 at the center hole 30*a*, so that the disc 30 selectively goes up and down the shaft 34 and is selectively rotated about the shaft 34**.

Figure 4A:
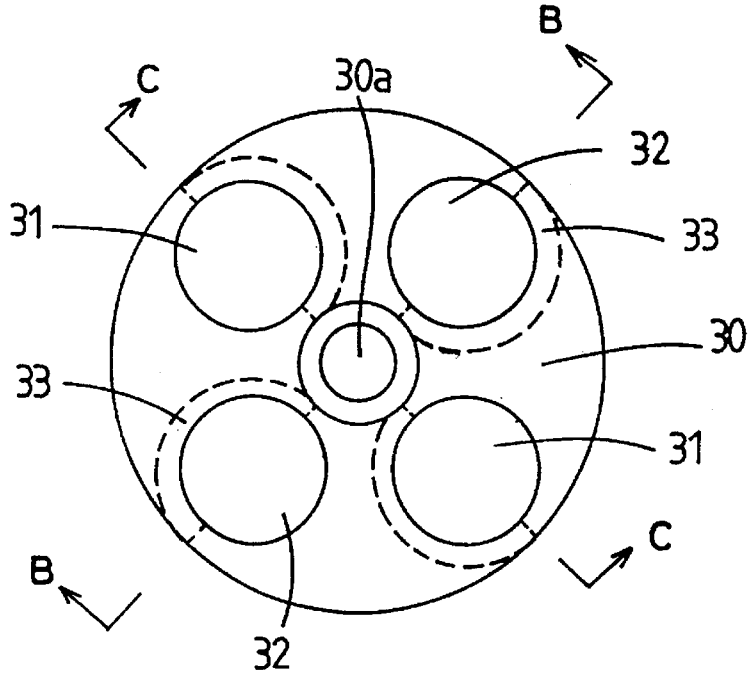
FIG. 4A is a plan view of a rotary blade disc of the reversible rotation device of the invention.
Figure 4B:
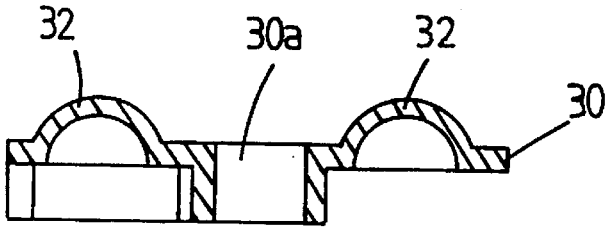
FIG. 4B is a sectional view of the rotary blade disc taken along the section line B—B of FIG. 4A.
Figure 4C:
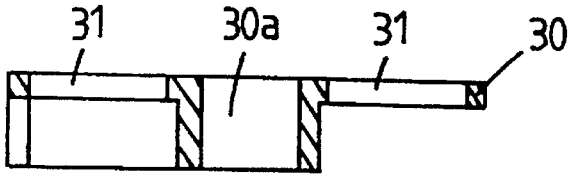
FIG. 4C is a sectional view of the rotary blade disc taken along the section line C—C of FIG. 4A.

The rotary blade disc 30 is provided with a pair of openings 31 as shown in FIGS. 4A to 4C, which openings 31 are diametrically opposed to each other. The disc 30 also has a pair of blocking domes 32, each dome 32 having a diameter larger than that of each first nozzle 21. The blocking domes 32 are provided between the openings 31, so that the domes 32 are diametrically opposed to each other. That is, the openings 31 and the domes 32 are spaced apart from each other at right angles and alternately placed on the blade disc 30.

A support disc 36 for limiting the lowermost position of and the rotating motion of the rotary blade disc 30 is coupled to the lower end of the shaft 34 as shown in FIG. 3B. The top surface of the support disc 36 has a pair of slopes **36*a*, which slopes 36*a* are formed on the disc 36 so that the slopes 36*a* are diametrically opposed to each other. Each of the slopes 36*a*** has an acclivous shape in the water flow direction.

As shown in FIG. 4A, the bottom surface of the rotary blade disc 30 is provided with a plurality of or four semicircular projections 33 on the edges of the openings 31 and on the edges of the blocking domes 32.

As described above, the rotary blade disc control unit 13 comprises the shaft 34, the rotary blade disc 30 and the support disc 36.

Figure 3D:
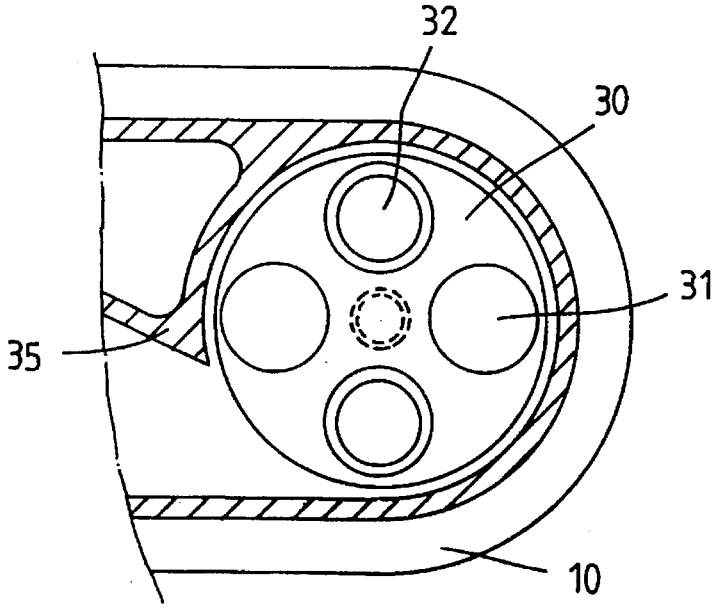
FIG. 3D is a sectional view of the spray arm of the invention taken along the section line A—A of FIG. 3A.

The spray arm reversible rotation device of the invention also includes a predetermined thickness of water guider 35 for letting the rotary blade disc 30 be rotated clockwise when looking downward the disc 30 in FIG. 3D. The water guider 35 diagonally extends from a predetermined position of the interior of the spray arm 10 to the front of the rotary blade disc 30.

Of course, it should be understood that the reversible rotation device of the invention may be upset and installed in the spray arm 10 without affecting the functioning of this invention.

Hereinbelow, the operational effect of the above reversible rotation device will be described.

Figure 5A:
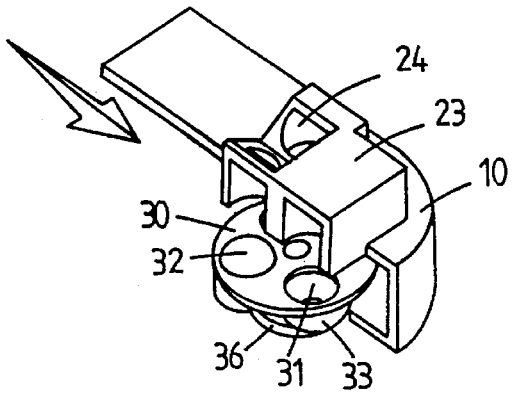
FIG. 5A is a perspective view showing a state of the spray arm reversible rotation device of the invention prior to supply of water to the interior of the spray arm.

FIG. 5A is a perspective view showing a state of the reversible rotation device when no water is supplied to the interior of the spray arm. As shown in this drawing, the rotary blade disc 30 is placed about the lower section of the shaft 34 when the water is not supplied to the interior of the spray arm 10 yet.

Figure 5B:
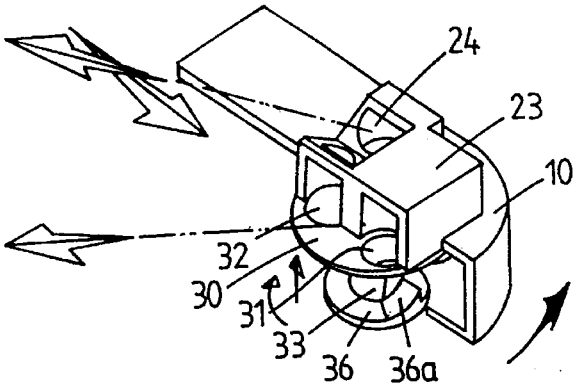
FIG. 5B is a perspective view showing a motion of the spray arm reversible rotation device of the invention when the water is supplied to the interior of the spray arm.

When a pump (not shown) in this state starts so as to supply the water to the interior of the spray arm 10 through the water inlet pipe 11, the water flows under the guide of the water guider 35 and collides against the semicircular projections 33 formed on the edges of the openings 31 and on the edges of the blocking domes 32 of the rotary blade disc 30, thus to rotate the disc 30 clockwise in FIG. 5B.

At this time, since the water flows in the interior of the spray arm 10 at a high speed, the rotary blade disc 30 is applied with thrusting force of the water, Therefore, the disc 30 goes up the shaft 34 simultaneously with rotating about the shaft 34.

While the disc 30 goes up the shaft 34 simultaneously with rotating about the shaft 34, either blocking dome 32 of the disc 30 is automatically fitted into either first nozzle 21 of the spray arm 10. At this time, since the blocking dome 32 has a smooth dome shape, the blocking dome 32 is reliably smoothly fitted into the first nozzle 21 and blocks the nozzle 21 even when the blocking dome 32 is not precisely aligned with the first nozzle 21.

That is, the rotation lifting motion of the rotary blade disc 30 makes either blocking dome 32 be fitted into and block either first nozzle 21 of the spray arm 10 and, at the same time, makes the other blocking dome 32 be fitted into and block the second nozzle 24 diagonally opposed to the blocked first nozzle 21. Thus, the water is jetted from the opened first nozzle 21 of the spray arm 10, so that there is generated water jetting force at the opened first nozzle 21. The water jetting force generated at the nozzle 21 causes the spray arm 10 to be rotated about the water inlet pipe 11 several times in a direction opposed to the water jetting direction of the opened jet nozzle 21 due to the third law of motion.

At the same time of rotation of the spray arm 10, the top spray nozzles 12 of the spray arm 10 spray the water upon the tableware in the tangential direction of the rotating direction of the spray arm 10. At this time, the opened second nozzle 24 of the spray arm 10 also jets the water upward at an oblique angle, thus to cover dead ground which is not covered by the water sprayed from the top spray nozzles 12. Therefore, the spray arm 10 of the invention improves its washing effect due to the second nozzles 24.

As either first nozzle 21 and its associated second nozzle 24, which nozzles 21 and 24 are diagonally opposed to the other, jet the water at the same time, the rotating motion of the spray arm 10 is promoted by the water jet from the second nozzle 24.

When a predetermined time has lapsed and the spray arm 10 has been rotated predetermined times in a direction, supply of water to the interior of the spray arm 10 is intermitted. In this case, the remaining water in the spray arm 10 will be discharged to the outside of the spray arm 10 under the guide of the water guider 35 as shown in FIG. 5C.

Such discharging of the remaining water to the outside of the spray arm 10 reduces the water pressure inside of the spray arm 10, so that the rotary blade disc 30 automatically goes down the shaft 34 due to its own weight. In designing of the reversible rotation device, the interval between the first nozzles 21 and the support disc 36 is designed, such that the semicircular projections 33 formed on the bottom surface of the rotary blade disc 30 slide down the slopes 36*a* of the support disc 36 simultaneously with separation of the top section of the blocking dome 32 of the disc 30 from an associated first nozzle 21. Therefore, when the rotary blade disc 30 automatically goes down the shaft 34 due to its own weight, the disc 30 is not rotated until the projections 33 come into contact with the slopes 36*a* of the support disc 36. However, when the projections 33 come into contact with the slopes 36*a* of the support disc 36, the projections 33 start to slide down the slopes 36*a*. The rotary blade disc 30 is thus rotated about the shaft 34 clockwise at a turning angle of about 70°–80° while going down the shaft 34. Thus, the rotary blade disc 30 will be placed about the lower section of the shaft 34.

Here, when designing the rotation device so as to rotate the lowering disc 30 about the shaft 34 at the turning angle of about 70°–80° as described above, it is facilitated to bring either blocking dome 32 of the disc 30 into engagement with either first nozzle 21 of the spray arm 10 when the water is supplied again to the interior of the spray arm 10 after intermission of supply of water. That is, when the water is supplied again to the interior of the spray arm 10 after intermission of supply of water, the rotary blade disc 30 starts to go up the shaft 34 nearly at the same time of rotating about the shaft 34. Therefore, the disc 30 may have finished its lifting motion before the disc 30 is rotated at right angle, so that the blocking dome 32 of the disc 30 may fail in blocking either first nozzle 21 of the spray arm 10. However, as the rotation device of this invention is designed such that the lowering disc 30 is only rotated about the shaft 34 at the turning angle of about 70°–80°, either blocking dome 32 of the disc 30 is readily brought into engagement with either first nozzle 21 of the spray arm 10 when the water is supplied again. Of course, it should be understood that the turning angle of the lowering disc 30 about the shaft 34 may be set as other angles besides the angle of 70°–80°.

Figure 5C:
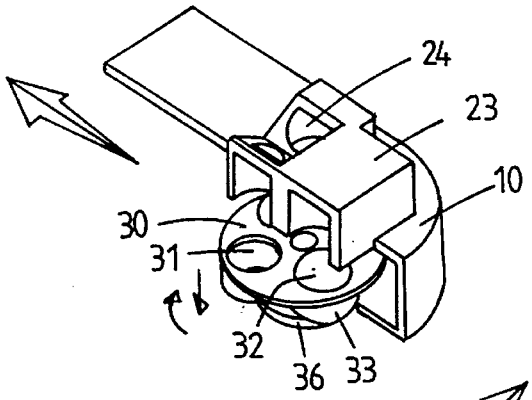
FIG. 5C is a perspective view showing a motion of the spray arm reversible rotation device of the invention when supply of water to the interior of the spray arm is intermitted.
Figure 5D:
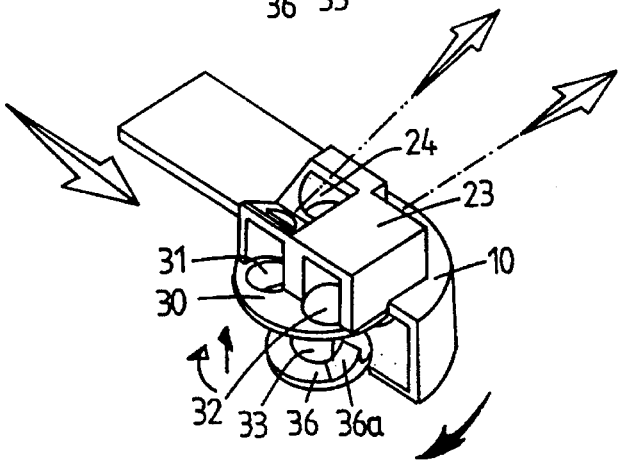
FIG. 5D is a perspective view showing a motion of the spray arm reversible rotation device of the invention when the water is supplied again to the interior of the spray arm after intermission of supply of water.

When the pump starts again in the state of FIG. 5C, the water is supplied again to the interior of the spray arm 10 after intermission of supply of water. Therefore, the water is introduced to the semicircular projections 33 of the rotary blade disc 30 under the guide of the water guider 35, thus to rotate the disc 30 clockwise at an angle of about 10°–20°. After clockwise rotation of the disc 30 at the angle of about 10°–20°, the semicircular projections 33 other than the two semicircular projections 33 that have slid down the slopes 36*a* of the support disc 36 are stopped by the back steps of the slopes 36*a*.

Therefore, the rotary blade disc 30 is not rotated about the shaft 34 any more, but goes up the shaft 34 due to thrusting force of the water. Therefore, either blocking dome 32 of the disc 30 is fitted into and blocks the other first nozzle 21 of the spray arm 10, which first nozzle 21 was opened in the previous water spraying operation of the spray arm 10. At the same time of blocking of the other first nozzle 21 by the blocking dome 32, the other blocking dome 32 is fitted into and blocks the second nozzle 24 diagonally opposed to the blocked first nozzle 21.

Therefore, the first nozzle 21 which was blocked in the previous spraying operation of the spray arm 10 is opened. Thus, the water is jetted from the opened first nozzle 21 of the spray arm 10, so that there is generated water jetting force at the opened first nozzle 21. The water jetting force generated at the nozzle 21 causes the spray arm 10 to be rotated about the water inlet pipe 11 several times in a direction opposed to the water jetting direction of the jet nozzle 21 due to the third law of motion. At this time, the rotating direction of the spray arm 10 is opposed to that in the previous spraying operation. At the same time of rotation of the spray arm 10, the top spray nozzles 12 of the spray arm 10 spray the water upon the tableware in the tangential direction of the rotating direction of the spray arm 10. At this time, the opened second nozzle 24 of the spray arm 10 also jets the water upward at an oblique angle, thus to cover dead ground which is not covered by the water sprayed from the top spray nozzles 12. Therefore, the spray arm 10 of the invention improves its washing effect due to the second nozzles 24. In addition, the rotating motion of the spray arm 10 is promoted by the water jet from the second nozzle 24.

In the reversible rotation device of the invention, the quantity of water jetted from the first nozzle 21 during the forward rotation of the spray arm 10 is equal to that of the other first nozzle 21 during the reverse rotation of the spray arm 10, so that the forward and reverse rotation periods of the spray arm 10 are equal to each other. In addition, the forward and reverse rotation periods of the spray arm 10 will be set in accordance with desired tableware washing effect of the spray arm 10.

As described above, a reversible rotation device for a spray arm of an automatic tableware washer in accordance with the invention includes a pair of first jet nozzles, which nozzles periodically alternately jet water so as to make the spray arm be rotated in opposed directions. In this regard, the water sprayed from top spray nozzles and from second jet nozzles of the spray arm covers all the interior of the tableware washer, thus to uniformly completely wash the inside and outside surfaces of the tableware, particularly of bowls, thus to improve the washing effect irrespective of position of the tableware inside the washer. The reversible rotation device of the invention thus lets a user of the washer be free from bothering about the positions of tableware in the washer when washing the tableware.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A spray arm for an automatic tableware washer comprising:

a plurality of top spray nozzles provided on a top plate of said spray arm, the spray arm being reversibly rotatable and hollow;

a pair of first water jet nozzles provided on an end section of the spray arm;

a pair of second water jet nozzles provided on said end section of the spray arm and spaced apart from the first water jet nozzles by a predetermined distance;

a deflector provided on an end section of the spray arm for guiding water from said first and second water jet nozzles, having opposing side openings above the first water jet nozzles for guiding the water in opposing directions, and having a V-shaped cutout notch formed above the second water jet nozzles so as to form obliquely spaced-apart and opposing openings for appropriately guiding water; and a rotary blade disc control unit placed in the interior of the spray arm under the first and second water jet nozzles, said control unit periodically alternately rotating the spray arm in an opposed direction.

2. The spray arm according to claim 1, wherein said rotary blade disc control unit includes:

a rotary blade disc for alternately blocking the pair of first water jet nozzles, said blade disc being movably fitted over said shaft; and a support disc for limiting rotation of said rotary blade disc, said support disc being coupled to a lower section of said shaft under said blade disc.

3. The spray arm according to claim 1, further comprising:

a water guide having a predetermined thickness for letting a rotary blade disc of said control unit be rotated clockwise when seen from above, said water guider diagonally extending from a predetermined position of the interior of the spray arm to the front of said blade disc.

4. The spray arm according to claim 2, wherein said support disc is provided with at least one slope on its top surface.

5. The spray arm according to claim 2, wherein said rotary blade disc is provided with at least one opening and at least one blocking dome on its top surface, said blocking dome being adapted for alternately blocking the pair of first water jet nozzles.

6. The spray arm according to claim 5, wherein the bottom surface of said rotary blade disc is provided with semicircular projections about said opening and about said blocking dome.

* * * * *